US010597822B2

(12) United States Patent
Lindblom

(10) Patent No.: US 10,597,822 B2
(45) Date of Patent: Mar. 24, 2020

(54) METHOD AND ARRANGEMENT FOR FIBER FLOW EQUALIZATION IN A REFINER

(71) Applicant: Valmet AB, Sundsvall (SE)

(72) Inventor: Thommy Lindblom, Hägersten (SE)

(73) Assignee: Valmet AB (SE)

( * ) Notice: Subject to any disclaimer, the term of this patent is extended or adjusted under 35 U.S.C. 154(b) by 626 days.

(21) Appl. No.: 15/122,672

(22) PCT Filed: Feb. 27, 2015

(86) PCT No.: PCT/SE2015/050230

§ 371 (c)(1),
(2) Date: Aug. 31, 2016

(87) PCT Pub. No.: WO2015/133962

PCT Pub. Date: Sep. 11, 2015

(65) Prior Publication Data

US 2017/0073894 A1 Mar. 16, 2017

(30) Foreign Application Priority Data

Mar. 5, 2014 (SE) ..... 1450243

(51) Int. Cl.
*D21D 1/30* (2006.01)
*B02C 7/02* (2006.01)
*B02C 7/12* (2006.01)

(52) U.S. Cl.
CPC ..... *D21D 1/306* (2013.01); *B02C 7/02* (2013.01); *B02C 7/12* (2013.01); *D21D 1/303* (2013.01)

(58) Field of Classification Search
CPC . B02C 7/12; B02C 7/02; D21D 1/303; D21D 1/306

(Continued)

(56) References Cited

U.S. PATENT DOCUMENTS 286,613 A 10/1883 Howland
3,815,834 A 6/1974 Gilbert (Continued)

FOREIGN PATENT DOCUMENTS

CA 974980 A 9/1975
CN 101481887 A 7/2009

(Continued)

OTHER PUBLICATIONS

Chinese Search Report for Application No. 201580011856.1 dated Sep. 4, 2017.

(Continued)

*Primary Examiner* — Kenneth E Peterson
*Assistant Examiner* — Nhat Chieu Q Do
(74) *Attorney, Agent, or Firm* — Lerner, David, Littenberg, Krumholz & Mentlik, LLP

(57) ABSTRACT

A refiner segment for a refiner for defibrating has a refining surface comprising a group of first bars and second bars, each having a first end directed in the direction of an inlet zone and a second end directed in the direction of a refining zone, where the second ends of the first bars are interlaced with the first ends of the second bars to form first grooves between the first bars, and second grooves between the second bars. The second ends of the first bars have a guiding surface decreasing from an upper surface of the first bars down towards the bottom of the second grooves, and the first ends of the second bars have a guiding surface increasing from the bottom of the first grooves up to a top of the second bars, such that the guiding surfaces form an equalization groove.

14 Claims, 13 Drawing Sheets

(58) Field of Classification Search
USPC ..... 241/261.2–261.3
See application file for complete search history.

(56) References Cited

U.S. PATENT DOCUMENTS

| | | | | |
|---|---|---|---|---|
| 4,039,154 | A * | 8/1977 | Peterson | D21D 1/306 241/261.3 |
| 8,474,739 | B2 * | 7/2013 | Ruola | B02C 7/12 241/261.2 |
| 2007/0057102 | A1 | 3/2007 | Virving | |
| 2008/0191078 | A1 | 8/2008 | Gingras | |
| 2009/0173812 | A1 | 7/2009 | Gingras | |
| 2012/0006924 | A1 | 1/2012 | Ruola | |
| 2012/0018549 | A1 | 1/2012 | Gingras | |
| 2013/0306769 | A1 | 11/2013 | Sjostrom et al. | |

FOREIGN PATENT DOCUMENTS

| | | | |
|---|---|---|---|
| CN | 101605938 | A | 12/2009 |
| EP | 2077352 | A1 | 7/2009 |
| EP | 2722433 | A1 | 4/2014 |
| GB | 1407712 | A | 9/1975 |
| JP | S4922649 | A | 2/1974 |
| JP | S5423706 | A | 2/1979 |
| JP | H0392793 | U | 9/1991 |
| JP | 2012520947 | A | 9/2012 |
| WO | 20071 06294 | A1 | 9/2007 |
| WO | 2008098153 | A1 | 8/2008 |
| WO | 2010106225 | A1 | 9/2010 |

OTHER PUBLICATIONS

International Search Report for Application No. PCT/SE2015/050230 dated Jun. 17, 2015.

* cited by examiner

METHOD AND ARRANGEMENT FOR FIBER FLOW EQUALIZATION IN A REFINER

CROSS-REFERENCE TO RELATED PATENT APPLICATIONS

The present application is a national phase entry under 35 U.S.C. § 371 of International Application No. PCT/SE2015/050230 filed Feb. 27, 2015, published in English, which claims priority from Swedish Application No. 1450243-9 filed Mar. 5, 2014, all of which are incorporated herein by reference.

TECHNICAL FIELD

The present invention relates to fiber refiners in general, and specifically to promoting equalization of fiber flow in such refiners.

BACKGROUND

Refiners used for manufacturing mechanical pulp typically comprise one or more refiner elements positioned oppositely and rotating relative to each other. The fixed i.e. stationary refiner element is called the stator of the refiner, and the rotating or rotatable refiner element is called the rotor of the refiner. In disc refiners, the refiner elements are disc-like and in cone refiners the refiner elements are conical. In addition to disc refiners and cone refiners, there are also what are called disc-cone refiners where disc-like refiner elements come first in the flow direction of the material to be defibrated and after them the material to be defibrated is refined further between conical refiner elements. Furthermore, there are also cylindrical refiners where both the stator and the rotor of the refiner are cylindrical refiner elements.

The refining surfaces of the refiner elements are formed by bars, i.e. bars and blade grooves i.e. grooves between the bars. The task of the bars is to defibrate the lignocellulosic material and the task of the grooves is to transport both material to be defibrated and material already defibrated on the refining surface. In disc refiners, which represent the most common refiner type, the material to be refined is usually fed through an opening in the middle of the stator i.e. on the inner periphery of the refining surface of the stator, to the space between the refiner surfaces of the discs i.e. to a blade gap. The refined material is discharged from the blade gap, from the outer periphery of the refining surfaces of the refiner discs, to be fed onwards in the pulp manufacturing process. The refining surfaces of the refiner discs may be either surfaces formed directly on the refiner discs, or they may be formed as separate blade segments positioned adjacent to each other in such a way that each blade segment forms part of a continuous refining surface. The same is true for cone refiners as well.

Usually, dams connecting two adjacent bars to each other are positioned at the bottom of the blade grooves of the refining surfaces of both the stator and the rotor of the refiner. The task of the dams is to guide the material to be refined and material already refined to the space between the bars of opposite refining surfaces to be further refined. Since the dams guide the material to be refined to the space between opposite blade bars, refining the material can be promoted thanks to the dams. Simultaneously, however, the dams cause the steam flow taking the material to be refined onwards in the blade grooves to decrease and prevent passage of the material to be refined and the material already refined on the refining surface by restricting the cross-sectional flow area of the blade grooves. This in turn leads to blockage on the refining surface, which then results in a decrease in the production capacity of the refiner, non-uniformity of the quality of the refined material and an increase in the energy consumed for the refining.

WO 2010/106225 A1 describes a refining surface that does not use dams for guiding the material into the blade gap between the opposite refining surfaces. The refining surface comprises first and second blade bars with blade grooves between them, as well as third blade bars located in the blade grooves between the first and second blade bars. The third blade bars have sloping ends that ascend from the bottom of the blade grooves up to the upper surfaces of the blade bars. The sloping ends are located at the end of the blade bars closest to the feed edge of the refining surface and thus form rising guide surfaces for guiding the material from the blade grooves between the blade bars to the upper surfaces of the blade bars and into the blade gap.

In any continuous process, minimizing variations is crucial for maximizing quality, minimizing costs and getting a stable process. This is also true for any pulp refining process in which fiber (wood or other lignocellulosic material.) is refined between refiner segments. The term lignocellulose refers to plant dry matter or so called lignocellulosic biomass. It is composed of carbohydrate polymers (e.g. cellulose, hemicellulose), and an aromatic polymer (lignin). These carbohydrate polymers contain different sugar monomers (six and five carbon sugars) and they are tightly bound to lignin. Lignocellulosic biomass can be broadly classified into virgin biomass, waste biomass and energy crops. Virgin biomass includes all naturally occurring terrestrial plants such as trees, bushes and grass. Waste biomass is produced as a low value byproduct of various industrial sectors such as agricultural (corn stover, sugarcane bagasse, straw etc), forestry (saw mill and paper mill discards). Energy crops are crops with high yield of lignocellulosic biomass produced to serve as a raw material for production of second generation biofuel examples include switch grass (*Panicum virgatum*) and Elephant grass.

Within pulp refining, variations in feed within the refining gap between the stator and rotor segments causes an increase in energy needed to maintain a predetermined or desired pulp quality and causes variations in end fiber quality. Therefore, there is a need for improving the design of the blade segments in order to overcome the above mentioned disadvantages.

SUMMARY

The present invention relates to pulp refining in general, and specifically to minimizing feed variations in pulp refiners.

In a first aspect, the present disclosure presents a blade segment for a refiner intended for defibrating lignocellulose-containing material, which blade segment has a refining surface and is arrangeable to form a part of a refining surface of the refiner. The blade segment has a feed edge directed in the direction of the feed flow of a material to be refined and a discharge edge directed in the direction of the discharge flow of the refined material, and the refining surface of the blade segment. Further, the refiner segment includes a group of at least two first blade bars and at least three second blade bars, each at least first and each of the at least three second blade bars has a first end directed in the direction of the feed edge and a second end directed in the direction of the discharge edge. In addition, the at least two first blade bars and the at least three second blade bars are arranged in an interlaced manner such that the second ends of the first blade bars are interlaced with the first ends of the second blade bars to form first valleys between said first blade bars corresponding to the width of the second blade bars, and to form second valleys between said second blade bars corresponding to the width of the first blade bars. Also, the second end of the at least two first blade bars has a respective guiding surface descending from an upper surface of the at least one first blade bar in the direction of the discharge edge to the second end, and the first end of the at least three second blade bars has a respective guiding surface ascending from the direction of the feed edge to an upper surface of said blade bar towards the second end. Finally, the second ends of the first blade bars and the first ends of the second blade bars are arranged to form an equalization groove substantially across and perpendicular to the first and second blade bars, wherein the equalization groove is configured to buffer and distribute a flow of material from a first valley between the at least two first blade bars into one or more second valleys formed between the at least three second blade bars.

Advantages of the present disclosure enable equalization of the flow of material over a refiner segment.

BRIEF DESCRIPTION OF THE DRAWINGS

The invention, together with further objects and advantages thereof, may best be understood by referring to the following description taken together with the accompanying drawings, in which.

DETAILED DESCRIPTION

The present disclosure relates to refiners in general, and specifically to an improved refiner segment bar design in which an equalization groove is manufactured across the bars in the segment, whereby the flow of material in the grooves between the bars is equalized.

In order to further the understanding of the benefits of the present disclosure, an in depth description of the disadvantages of current prior art will follow below.

In most refiner arrangements, feed variations occur across the refiner geometry. These vary over time, over the refiner geometry (over the ring). In order to avoid shives in the less fiber populated zones, the gap between the stator and rotor segments is typically adjusted inwards e.g. reduced, which causes higher energy consumption and production of fines (dust) in the more fiber populated zones. This causes higher energy consumption and reduced fiber quality. Shives comprises small bundles of incompletely cooked wood fibers in the chemical pulp used in papermaking. They are smaller than knots and are more difficult to separate from the pulp. An excess of shives is a sign of poor impregnation of the wood chips. Shives are separated from the pulp in the screening and can be added back after refining. Even though shives are darker than rest of the pulp, they may pass unnoticed to the paper machine because they are easily bleached. Shives in the paper machine can cause web breakage or other operational problems. They might also end as spots in the finished product.

Figure 1:
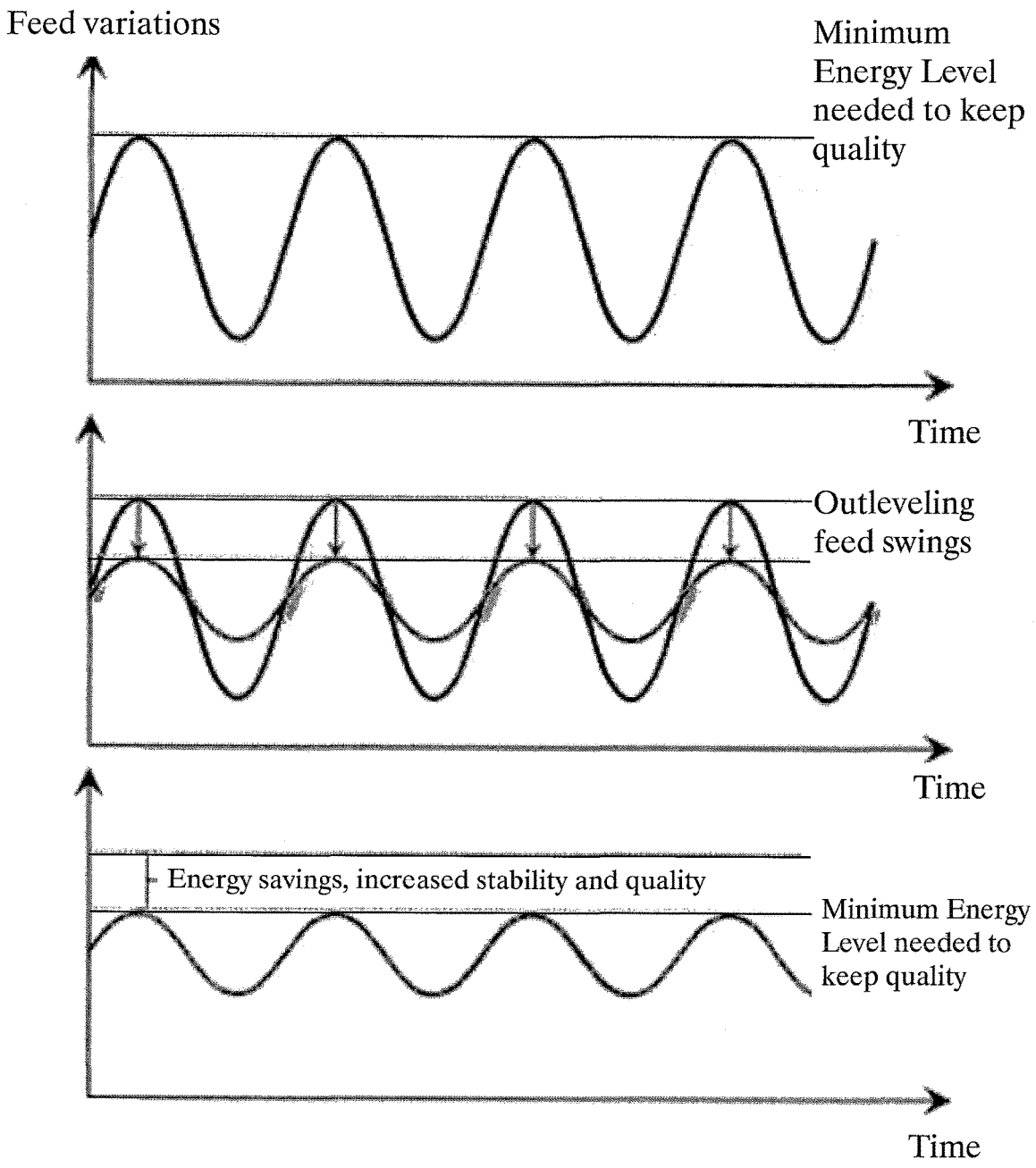
FIG. 1 is a diagram illustrating feed variations over time in a refiner arrangement.

In the graphs of FIG. 1, the effect of reducing the feed variations over time is illustrated. In the top most graph the feed variations (at a set nominal feed) for a typical refiner geometry is plotted as a function of time. As indicated by the horizontal line, a certain minimum energy level or input is necessary in order to compensate for the feed variations in order to maintain a certain quality of the refined pulp. By providing some means of reducing the variations in the feed variations as a function of time, the minimum energy level at a predetermined quality is reduced, as illustrated in the middle graph. Finally, in the bottom graph the feed variations over time after the variations have been reduced is illustrated. It is evident that any method or arrangement which reduces the variations in feed variations over time will provide a reduced energy level or input whilst maintaining a certain quality.

Figure 2:
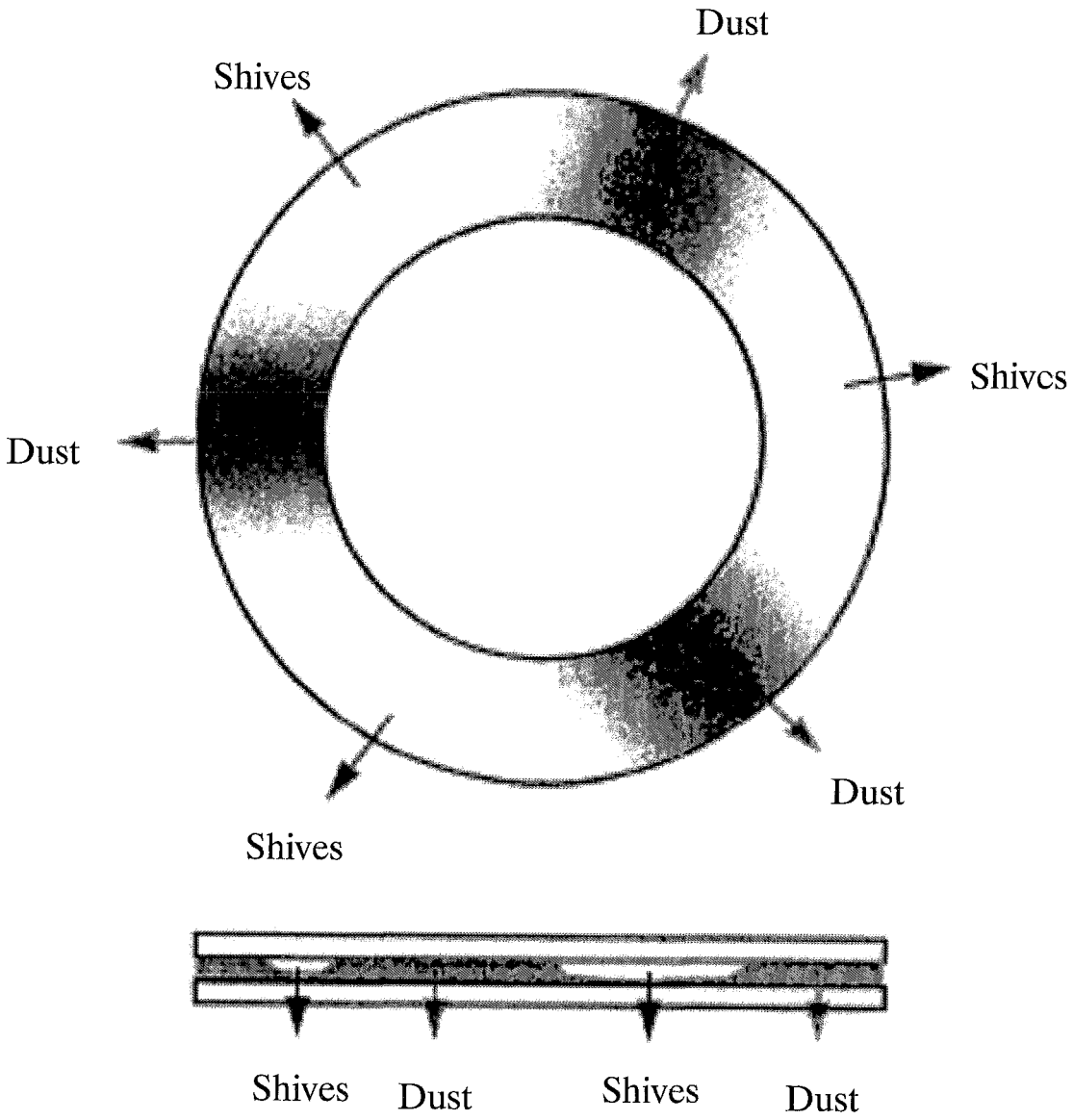
FIG. 2 is a schematic illustration on the distribution of material over a refiner surface in prior art.

In FIG. 2, the variation of shives and dust over a refiner surface or zone is illustrated.

Figure 3:
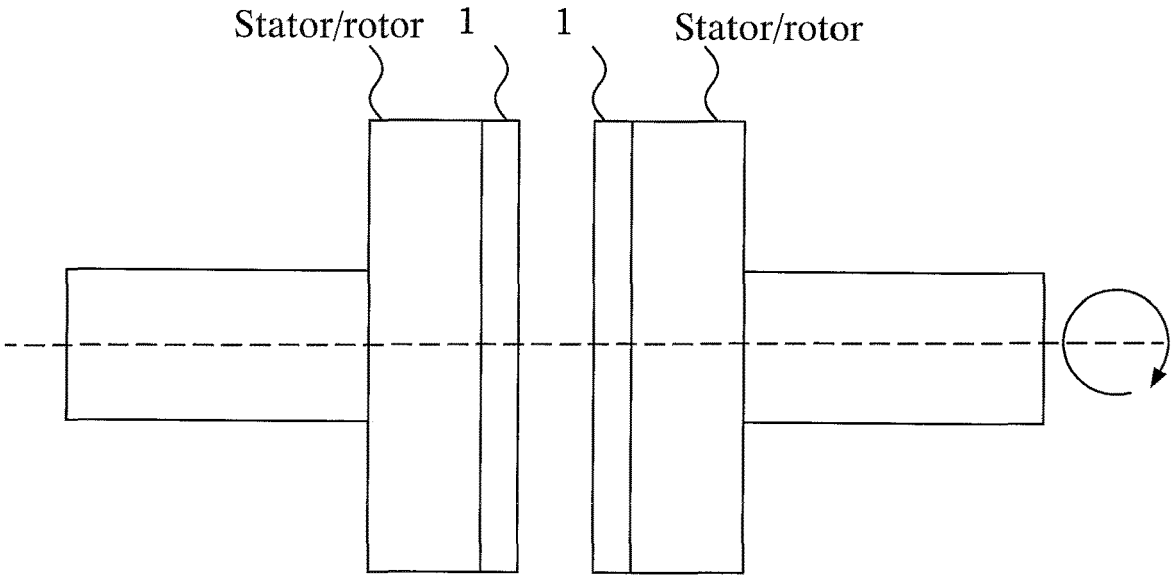
FIG. 3 is a side view of a refiner arrangement in which the current disclosure can be implemented.
Figure 4:
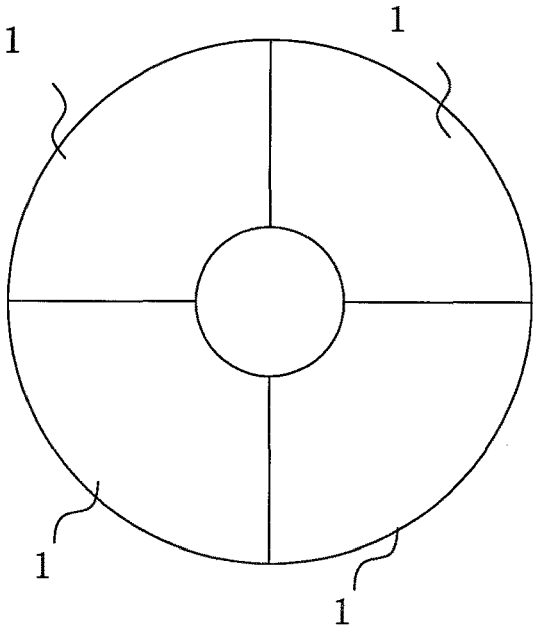
FIG. 4 is a front view of a stator/rotor with refiner segments according to the current disclosure.

For further clarification and illustration a schematic refiner segment is illustrated in FIG. 3. This illustrates a refiner comprising a coaxially arranged stator/rotor disc pair. At least one of the discs is provided with a refiner surface comprising a plurality of refiner segments 1, as illustrated in FIG. 4. The stator/rotor disc pair can comprise one stator and one rotor, or two rotors. Further, in the current disclosure the main emphasis is on disc refiners, but the disclosure can be equally implemented in other refiner geometries as well. It should be noted, that in case of the rotor/rotor arrangement the two rotors are configured with opposing rotational directions.

Accordingly, the inventors have identified the need for a solution that enables distributing the flow of the pulp across the refiner gap/zone to more efficiently utilize all the bars of the segments 1. Therefore a fiber flow equalization unit is provided on the segments 1, which distributes the flow evenly over each following groove and over time. According to a particular embodiment, the equalizer comprises an equalization groove 40 which allows the flow to choose a following groove that is not full with fibers without losing too much speed. In the equalization groove 40 the open volume initially decreases and subsequently suddenly increases which provides a buffer and then an explosion which helps to equalize the flow over time. The term explosion refers to the combination of fiber and steam (in essence all the material between opposing segments) that explodes due to the pressure and volume change. Part of the fiber can be defibrated by this explosion but the greater effect is the distribution of the fiber into a subsequent groove is homogenized.

The equalization groove 40 according to the present disclosure is provided across the substantially radially arranged grooves and bars. In essence, the equalizer comprises two features, namely a flow reducing section and a reservoir and distribution section. The flow reducing section comprises grooves that are designed to be more narrow, or fewer than the majority of the provided refiner grooves on the segment. Thereby creating a flow differential across the refiner surface. The reservoir and distribution section comprises the equalization groove, which enables stemming the flow of pulp and distributing the flow evenly across the available refiner grooves. This is a form of water filling principle, where the reservoir distributes the flow to the grooves that have less fiber than neighboring grooves.

According to a particular embodiment, the equalization groove 40 is a single groove per segment, but it is equally possible to design the groove as a series of grooves arranged across the segment. However, typically there is no benefit in providing more than one equalization groove when the fiber is moving from an inlet e.g. inlet zone 2 towards an outlet edge e.g. refining zone 3 of the segment 1.

Figure 5:
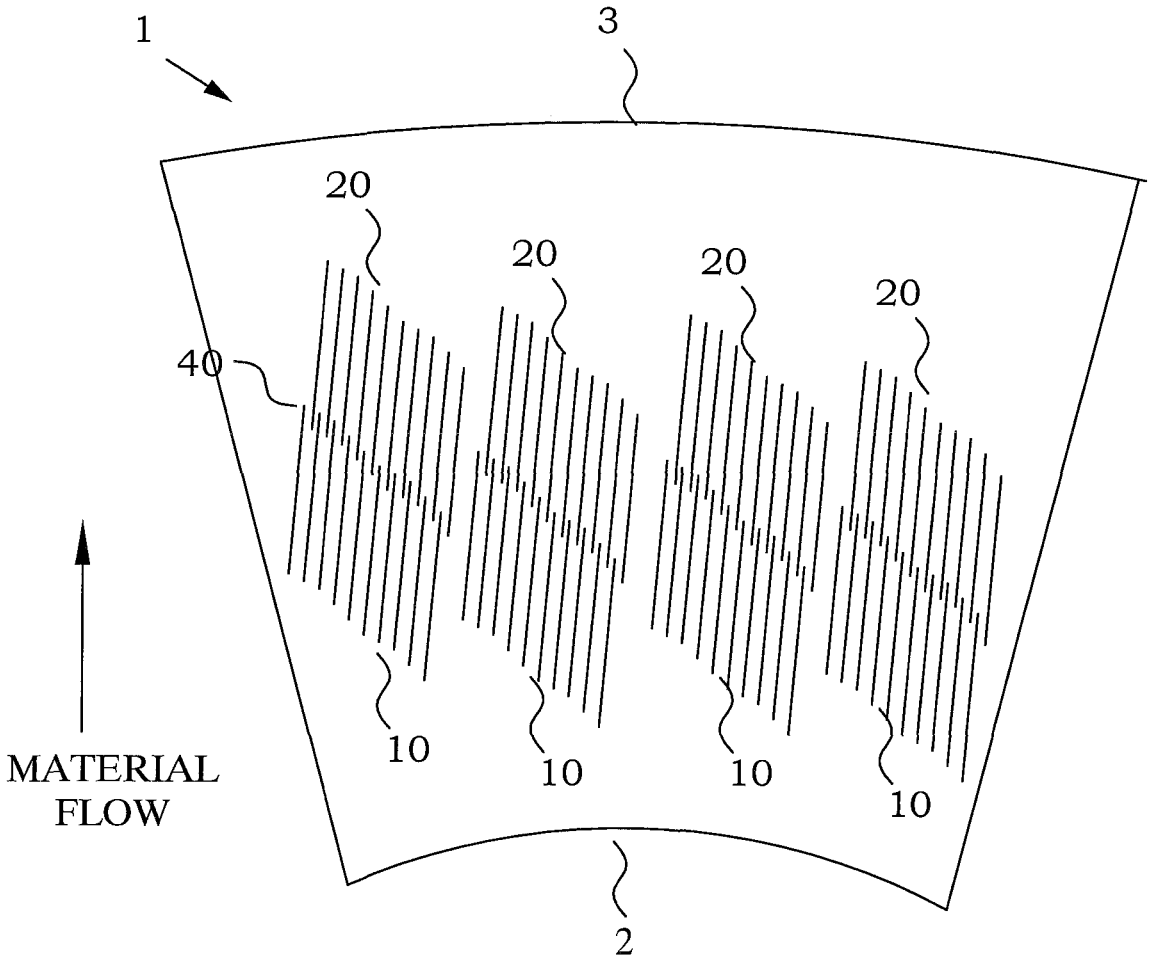
FIG. 5 illustrates an embodiment of a refiner segment according to the present disclosure.

With reference to FIG. 5, a basic embodiment of a refiner segment 1 according to the current disclosure is illustrated. The refiner segment 1 is beneficially implemented in a refiner intended for defibrating lignocellulose-containing material e.g. wood chips or other lignocellulosic material. The refiner segment 1 has a refining surface arranged between an inlet zone 2 and a refining zone 3 and is arrangeable to form a part of the refining surface of the refiner. In order to do so the refiner segment 1 has an inlet zone 2 directed in the direction of the feed flow of a material to be refined and a refining zone 3 directed in the direction of the material flow of the refined material. The refining surface of the refiner segment 1 includes a group of at least two first bars 10 and at least three second bars 20, each at least first and each at least three second bars 20 has a first end 10-1, 20-1 directed in the direction of the inlet zone 2 and a second end 10-2, 20-2 directed in the direction of the refining zone 3. Thereby, material that enters the refining zone 3 from the inlet zone 2 will first pass over and between the first bars 10 and subsequently pass the second bars 20.

The at least two first bars 10 and the at least three second 20 bars are arranged in an interlaced manner in which the second ends 10-2 of the first bars 10 are interlaced with the first ends 20-1 of the second bars 20-1 to form first grooves 30-1 between the first bars 10 corresponding to at least the width of the second bars 20, and to form second grooves 30-2 between the second bars 20 corresponding to at least the width of the first bars 10. The second end 10-2 of the at least two first bars 10 has a respective guiding surface R1 or chamfer decreasing from an upper surface of the at least one first bar in the direction of the refining zone 3 to the second end 10-2. In a corresponding manner, the first end 20-1 of the at least three second bars 20 has a respective guiding surface R2 or chamfer increasing from the direction of the inlet zone 2 to an upper surface of the bar 20 towards the second end 20-2. In this embodiment the second ends 10-2 of the first bars 10 and the first ends 20-1 of the second bars 20 are arranged to form an equalization groove 40 substantially across and perpendicular to the first and second bars 10, 20, such that the equalization groove 40 is configured to buffer and distribute a flow of material from at least one of the first grooves 30-1 between the at least two first bars 10 into one or more of the second grooves 30-2 formed between the at least three second bars 20.

In the embodiment in FIG. 5, the groups of bars 10, 20 are illustrated as forming more or less isolated structures on the surface of the segment 1. However, it is understood that the second ends 20-2 of the second bars 20 can be configured to extend to the outer edge or refining zone 3 of the segment 1 and that the first ends 10-1 of the first bars 10 can be configured to extend near to the inner edge or inlet zone 2 of the segment 1.

Figure 6:
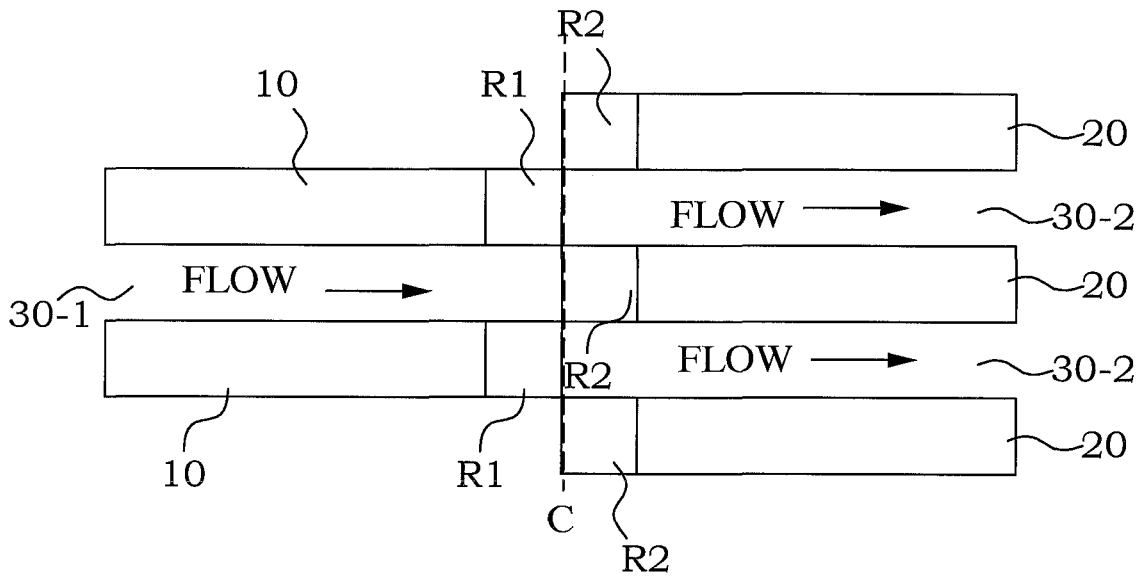
FIG. 6 illustrates a top view of part of an embodiment of a refiner segment according to the present disclosure.
Figure 7:
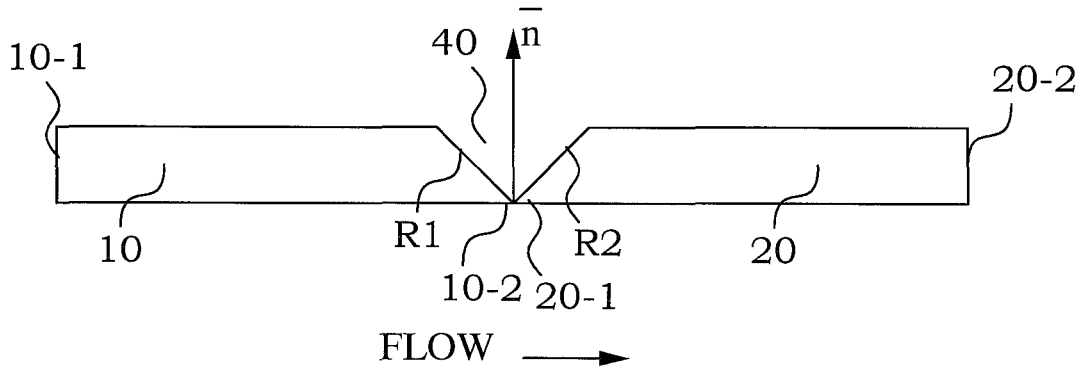
FIG. 7 illustrates a side view of the embodiment of FIG. 6.

According to a particular embodiment, with reference to FIG. 6 and FIG. 7, the second ends 10-2 of the first bars 10 and the first ends 20-1 of the second bars 20 are arranged such that the ends are aligned along a same line C to form a v-shaped equalization groove 40 which has the same depth as the respective heights of the first and second bars 10, 20. Thereby, the term "interlaced" includes the situation where there is no overlap between the first and second bars 10, 20. In the side view of FIG. 7, the respective ramps or guiding surfaces R1, R2 are configured such that the equalization groove 40, when viewed in a direction perpendicular to a lengthwise direction of the first and second bars 10, 20 and a normal direction to the refiner segment 1, is formed by inclined opposing surfaces formed by the first guiding surfaces R1 and said second R2 guiding surfaces. Depending on the configuration of the guiding surfaces R1, R2 and the respective first and second bars 10, 20, the cross sectional shape of the equalization groove may vary. Generally, a distance between the inclined opposing surfaces of the guiding surfaces increases along a normal direction to the refining segment. The increase can be linear or polynomial, or have some other form. For the case of linear and equal guiding surfaces, the equalization groove 40 will take a V-shape.

Figure 9:
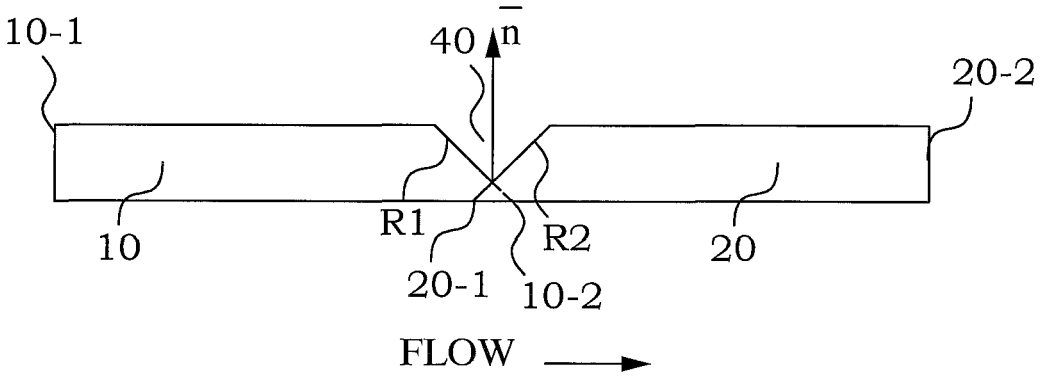
FIG. 9 illustrates a side view of the embodiment of FIG. 8.
Figure 10:
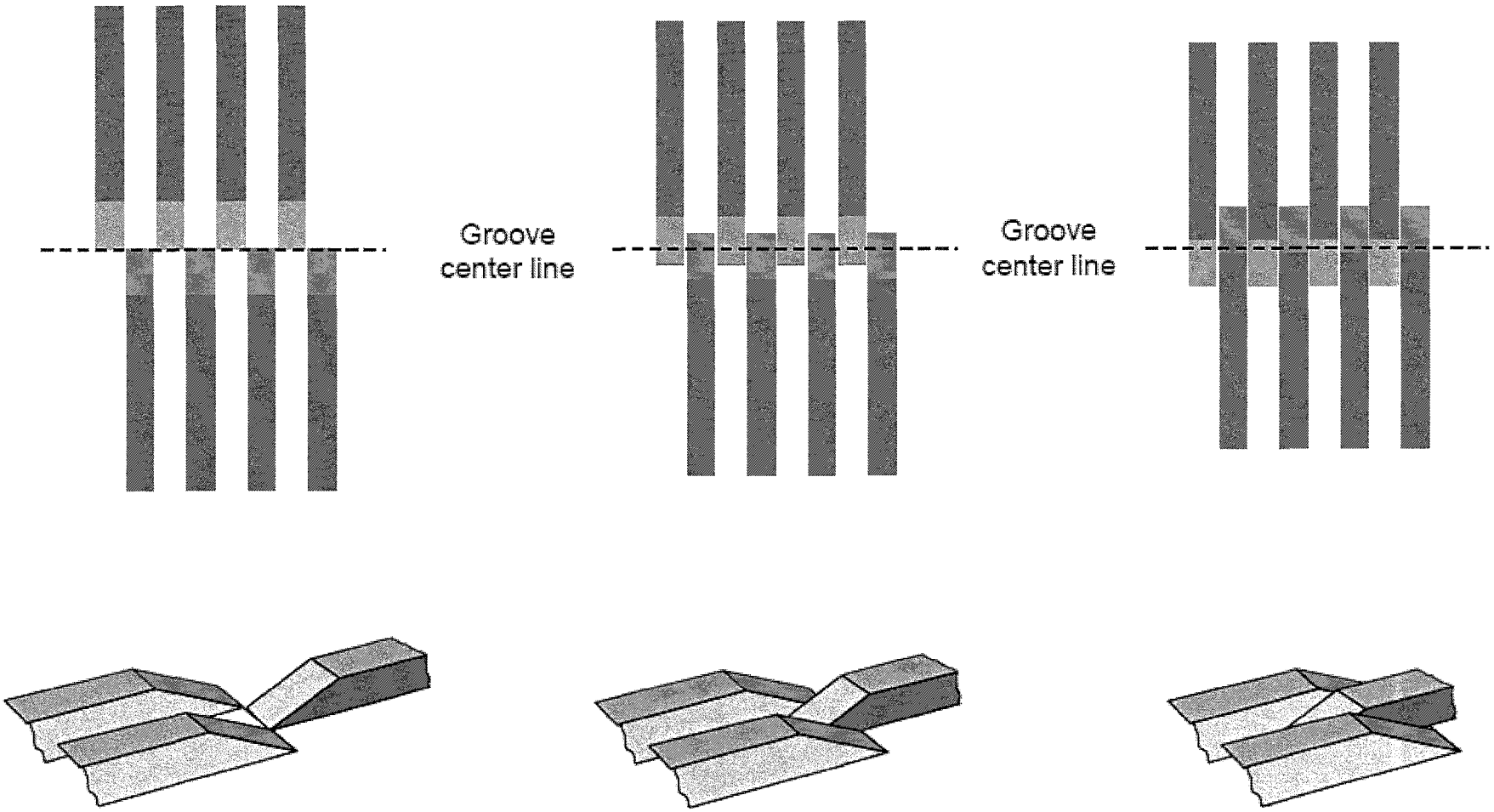
FIGS. 10-16 illustrate various embodiments of the current disclosure

It should be noted that the first ends 10-1 of the first bars 10 and the second ends 20-2 of the second bars 2 can be configured in accordance with the disclosed illustrations e.g. FIG. 7, FIG. 9, or can be configured with a corresponding or similar guiding surface or chamfer or other shape as the respective second ends 10-2 of the first bars 10 and the first ends 20-1 of the second bars.

According to a particular embodiment the respective guiding surfaces R1 and R2 have the same inclination, but it is equally possible to have differing inclinations.

In a corresponding manner the height and width of the first and second bars 10, 20 can differ, thereby affecting the shape of the equalization groove 40.

For the embodiment illustrated in FIG. 6, the equalization groove 40 has a depth equal to a depth of the first 30-1 and/or second 30-2 valleys.

Figure 8:
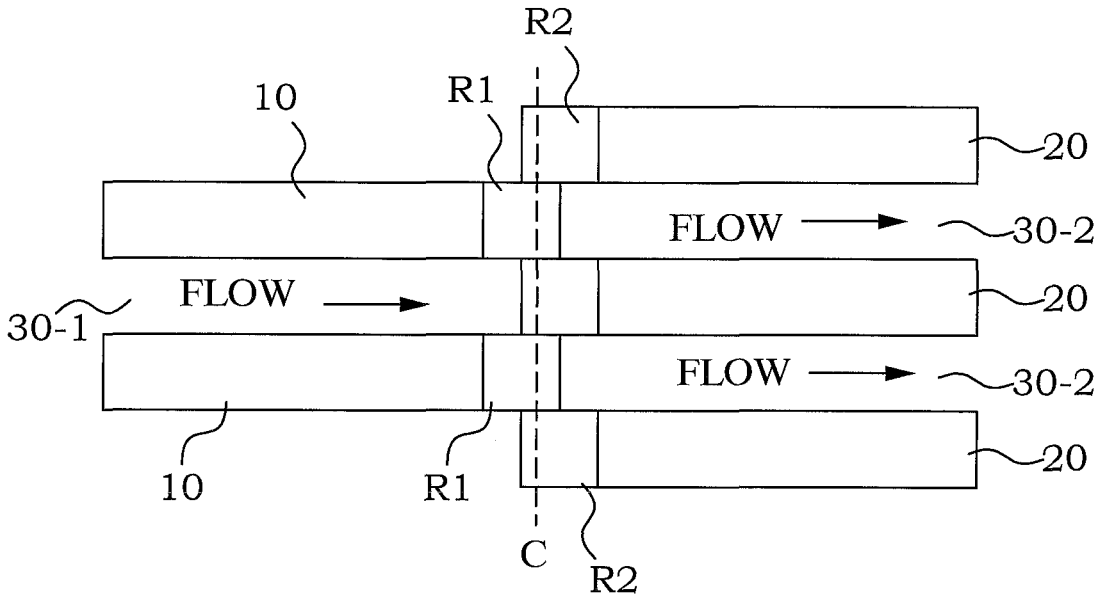
FIG. 8 illustrates a top view of part of a further embodiment of a refiner segment according to the present disclosure.

With reference to FIG. 8 and FIG. 9, a further embodiment of a refiner segment 1 will be described. In this case, the first 10 and second 20 bars are arranged in an interlaced manner such that the bars of the two groups are clearly overlapping. Consequently, the second ends 10-2 of the first bars 10 and the first ends 20-1 of the second bars 20 are not aligned along a same line C, but rather displaced a distance across the line C. Thereby forming an equalization groove 40 along line C which has a depth that is less than the depth of the first or second grooves 30-1, 30-2. This is clearly illustrated in FIG. 9.

As indicated in FIG. 5, a refiner segment 1 according to the current disclosure includes a plurality of groups of first and second bars 10, 20, each of which includes a respective equalization groove 40.

With reference to FIGS. 10-16 a plurality of embodiments of the current disclosure will be described.

As described previously, and now with reference to FIG. 10, the first 10 and second 20 bars can be more or less interlaced. In the figure the arrangement of the first and second bars 10, 20 is illustrated as viewed from above and in a side view, also the center line of the equalization groove is indicated with a doted line. In the leftmost illustration the ends of the first and second bars 10, 20 are aligned along the equalization groove 40 without overlapping. In the center illustration the ends of the first and second bars 10, 20 overlap a small distance e.g. the chamfers R1, R2 of the respective bars overlap. Finally, in the rightmost illustration the first and second bars 10, 20 overlap to the extent that the equalization groove 40 is a very shallow and narrow groove.

Figure 11:
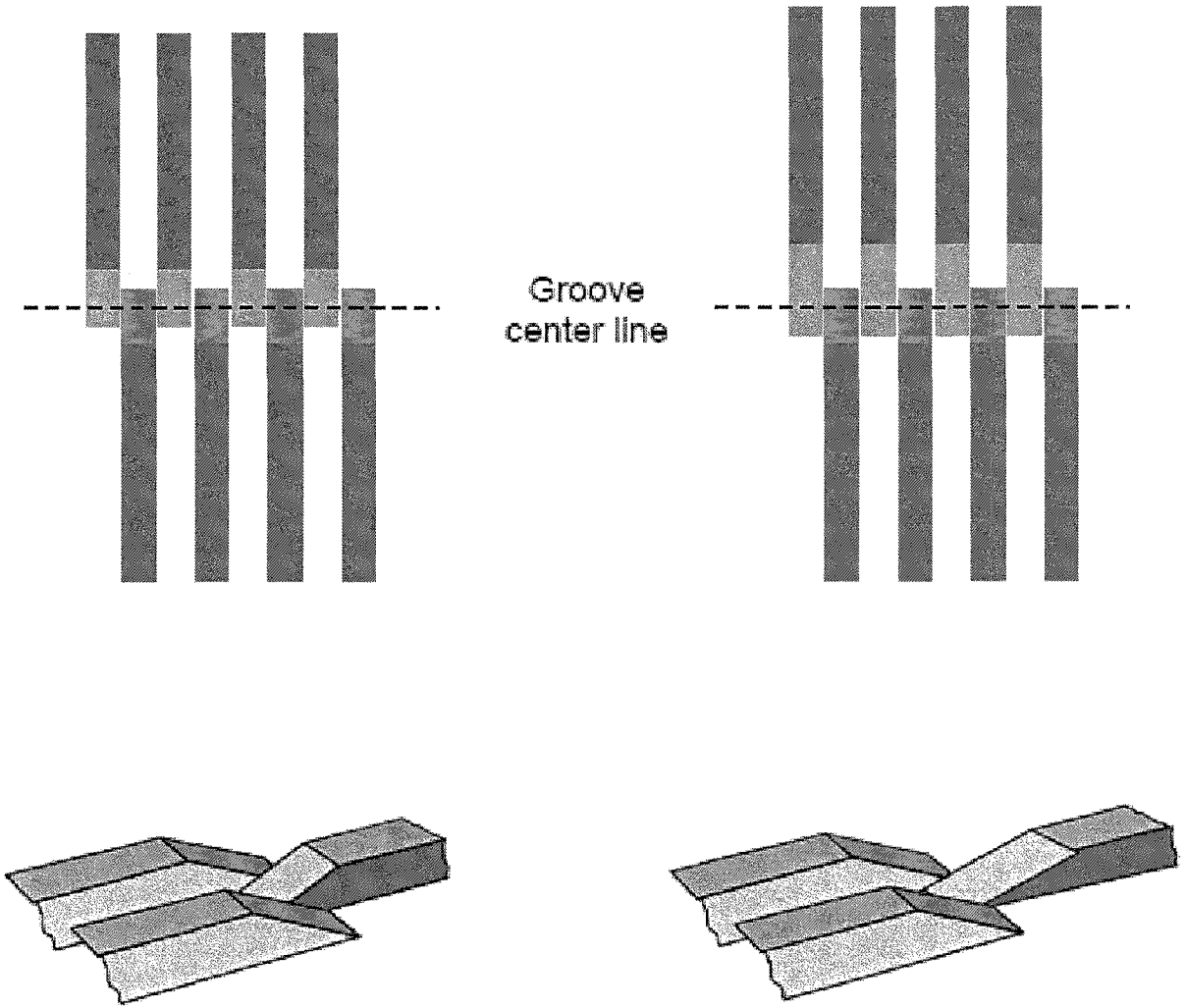

With reference to FIG. 11, the guiding surfaces R1, R2 or chamfers of the bars 10, 20 can have identical inclination and length, as illustrated in the leftmost drawing. However, they can also have differing inclination and length, as illustrated in the rightmost drawing. Thereby, the equalization groove 40 can have a symmetrical or a-symmetrical V-shape.

Figure 12:
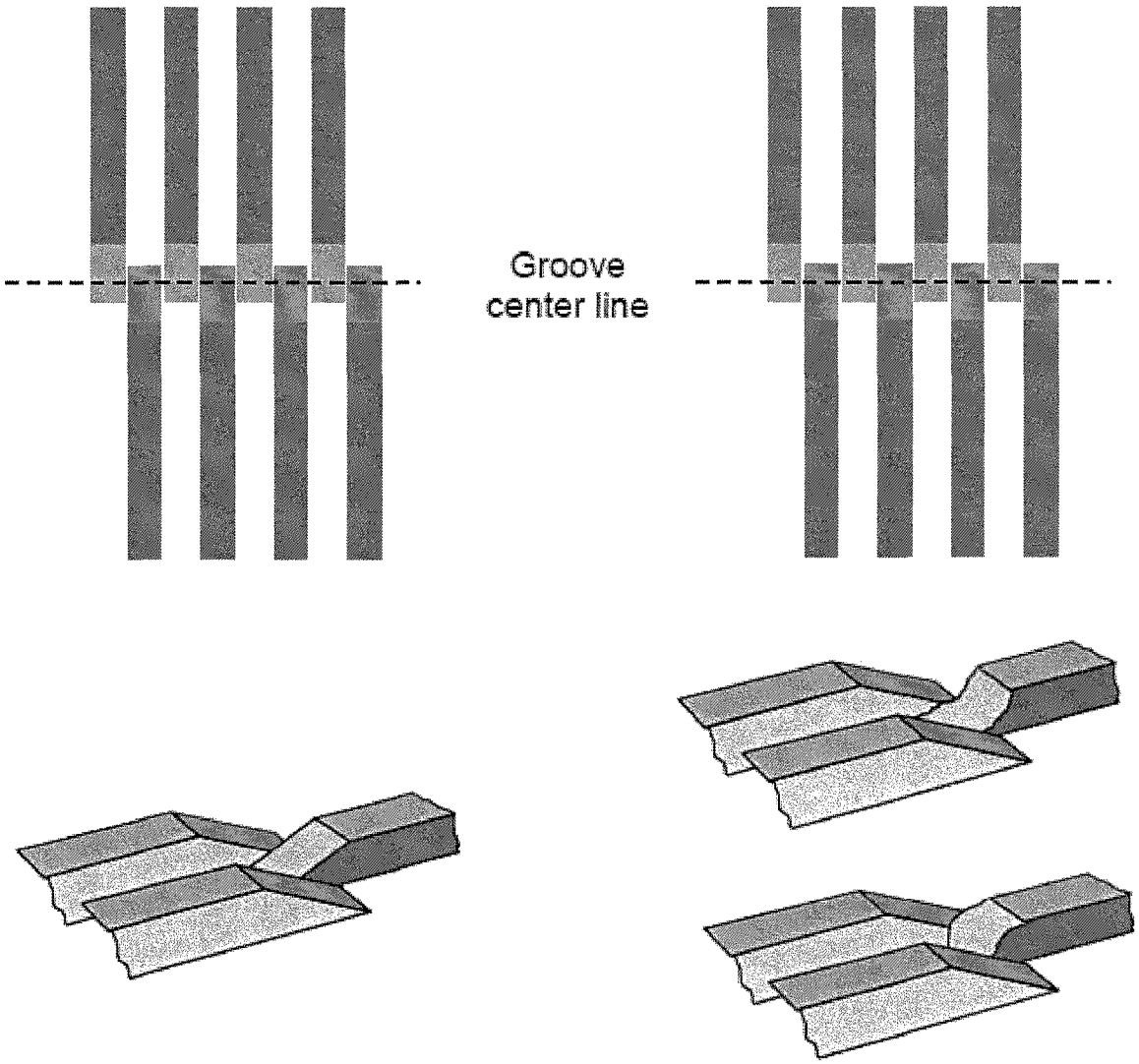

With reference to FIG. 12, the guiding surfaces R1, R2 (as mentioned previously) can have a respective linear, straight shape as illustrated in the leftmost drawing, but they can also have a non-linear or irregular shape as illustrated in the rightmost drawing. In this embodiment, only the guiding surface R2 of second bars 20 have an irregular shape, whereas the guiding surface R1 of the first bars 10 have a linear shape. Also other combinations are possible, such as the previously mentioned polynomial shape or other irregular shapes.

Figure 13:
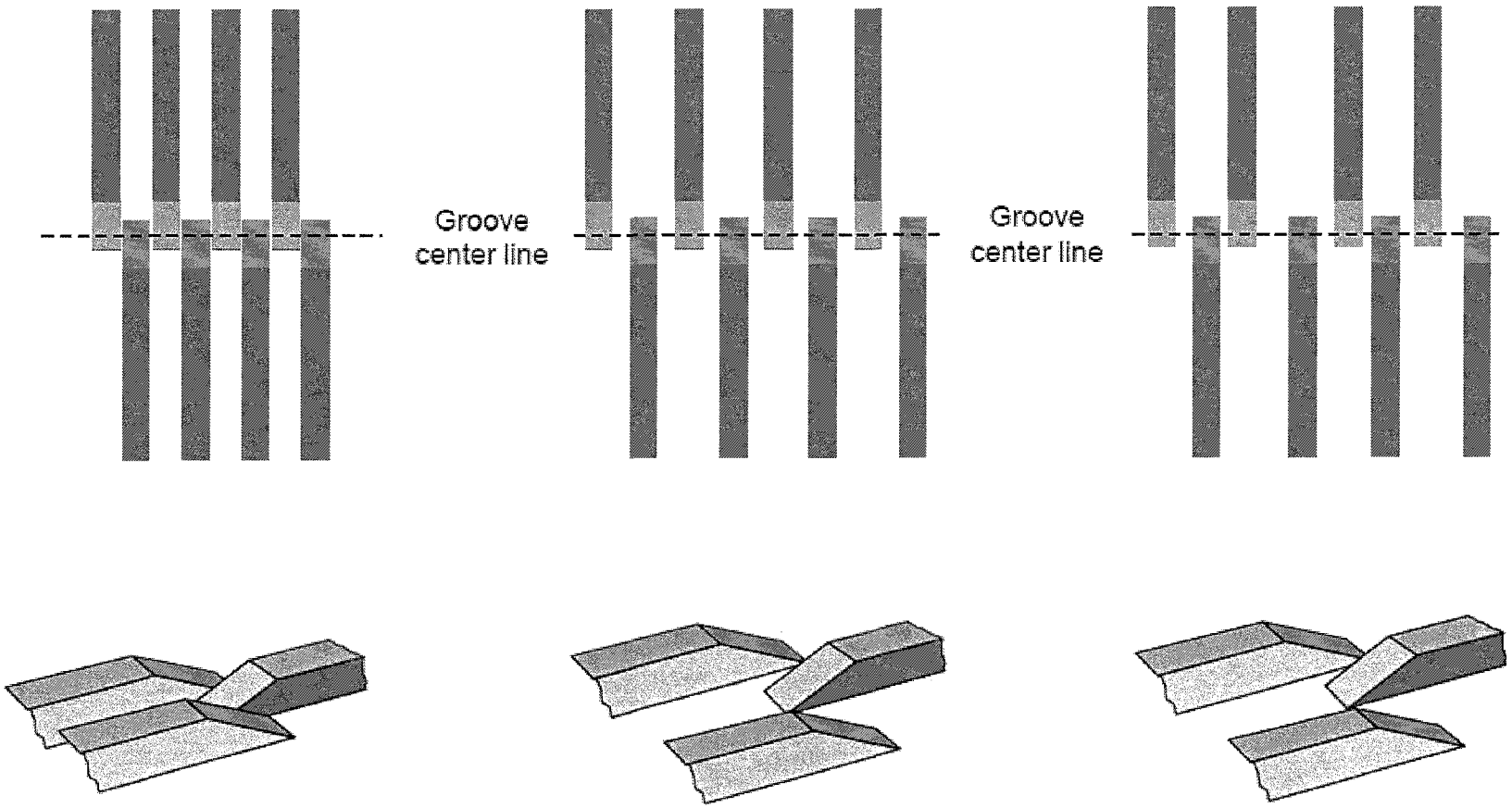

With reference to FIG. 13, embodiments where the width of the grooves 30-1, 30-2 are varied will be described. In most embodiments mentioned previously in this description, the width of the respective grooves 30-1, 30-2 corresponds to the respective widths of the first and second bars 10, 20, as shown in the leftmost illustration. However, it is also possible to have a groove width that differs from the width of the respective first and second bars 10, 20. Also the position of the respective bars 10, 20 relative the facing groove 30-2, 30-1 can vary. In the center illustration the first bars 10 are aligned with the center line of the facing groove 30-2, and correspondingly the second bars 20 are aligned with the center line of the facing groove 30-1. However, it is possible to have the bars un-aligned with the facing groove, as illustrated in the rightmost drawing. Further, the width of the respective grooves is not necessarily the same for all grooves within the groups of respective first and second bars 10, 20, which is also illustrated in the rightmost drawing.

Figure 14:
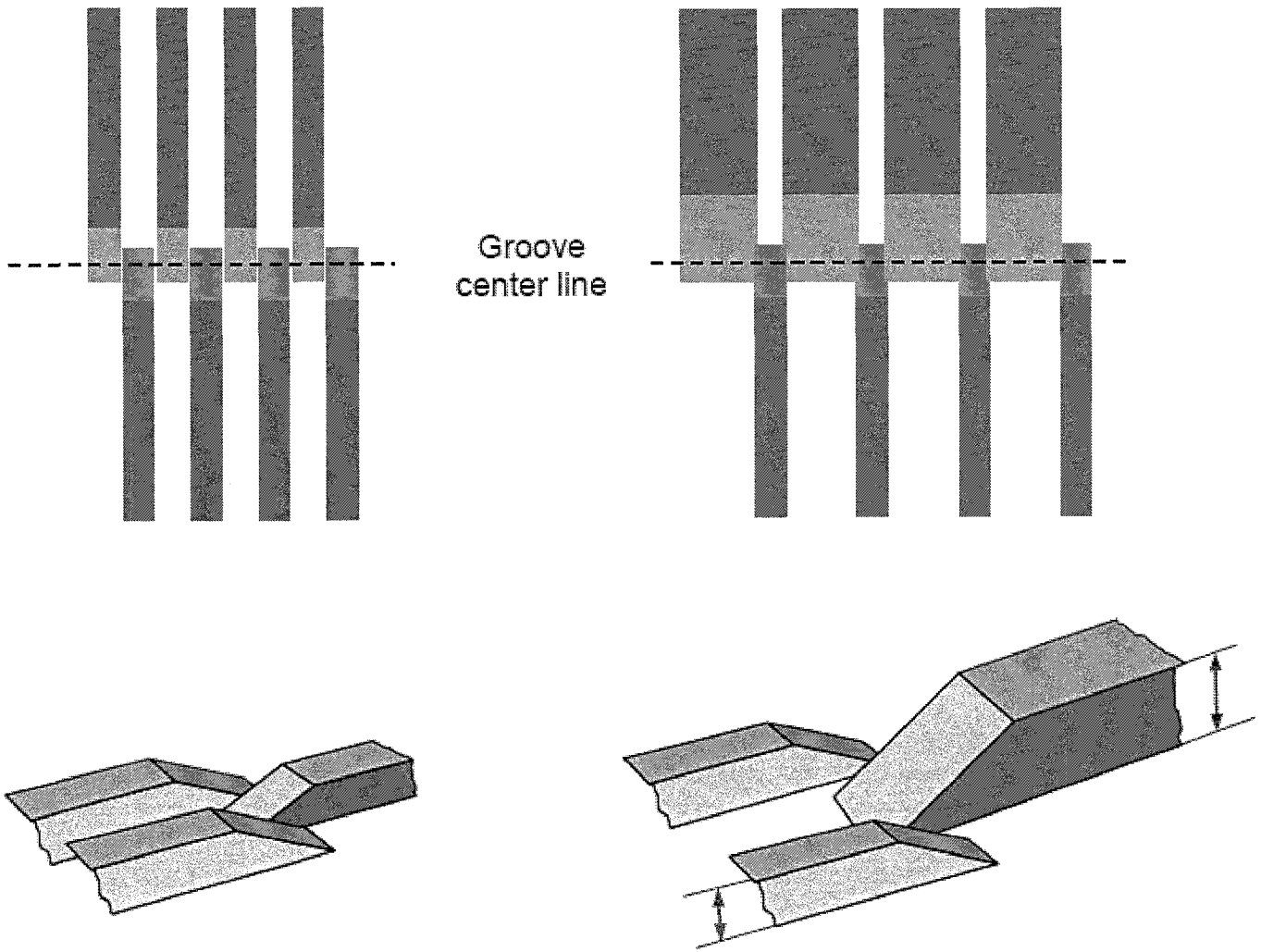

With reference to FIG. 14, an embodiment with varying height and width of the first and second bars 10, 20 will be described. The leftmost illustration shows the case of having first and second bars 10, 20 that are equal in height and width. In the rightmost illustration the second bars 20 are both wider and have a larger height than the first bars 10, or vice versa.

Figure 15:
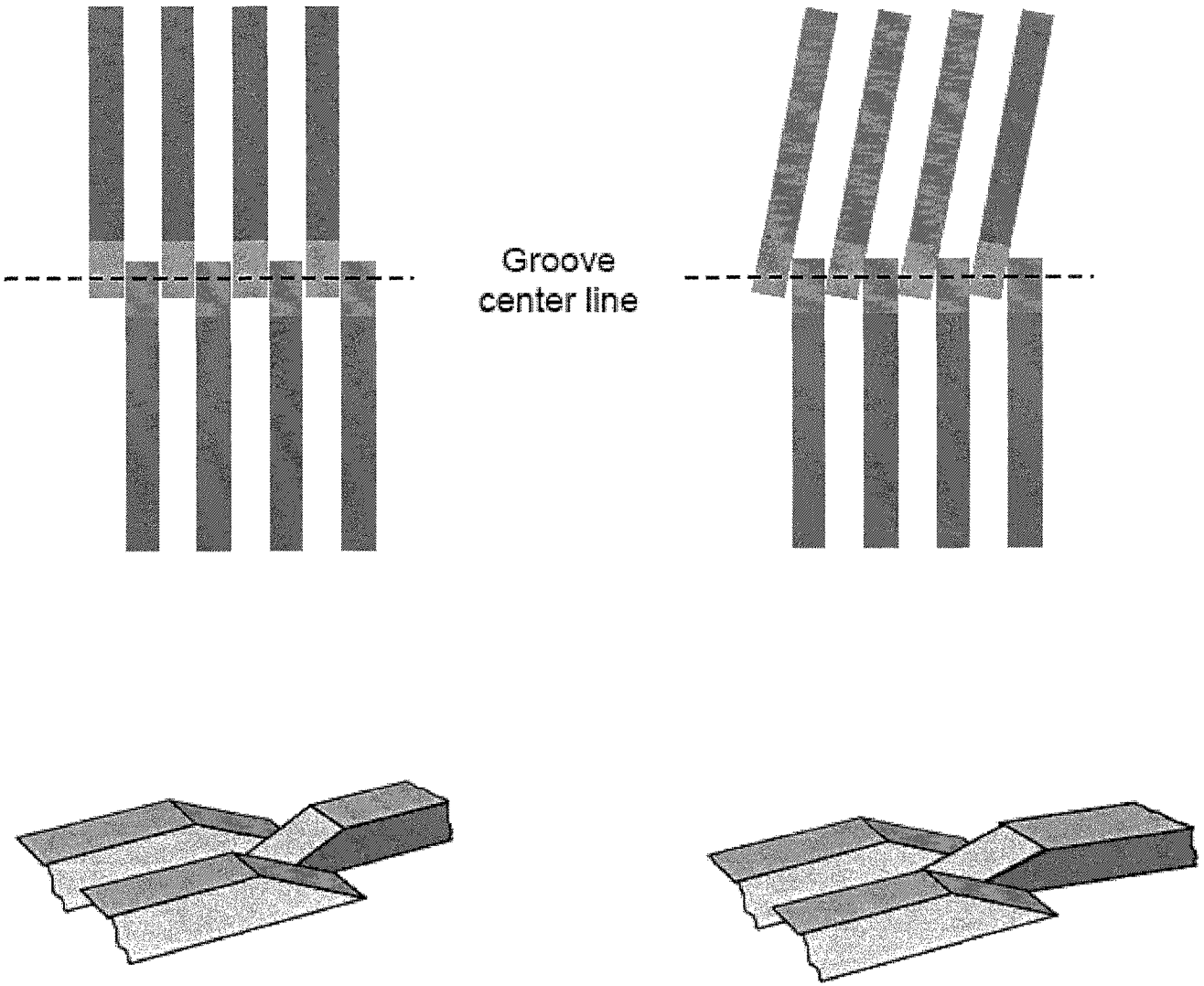

Additionally, with reference to FIG. 15, the respective groups of first and second bars 10, 20 can be arranged at an angle relative each other. In the leftmost illustration the first and second bars 10, 20 are aligned, whereas in the rightmost embodiment the first and second bars 10, 20 are arranged at an angle relative each other.

Figure 16:
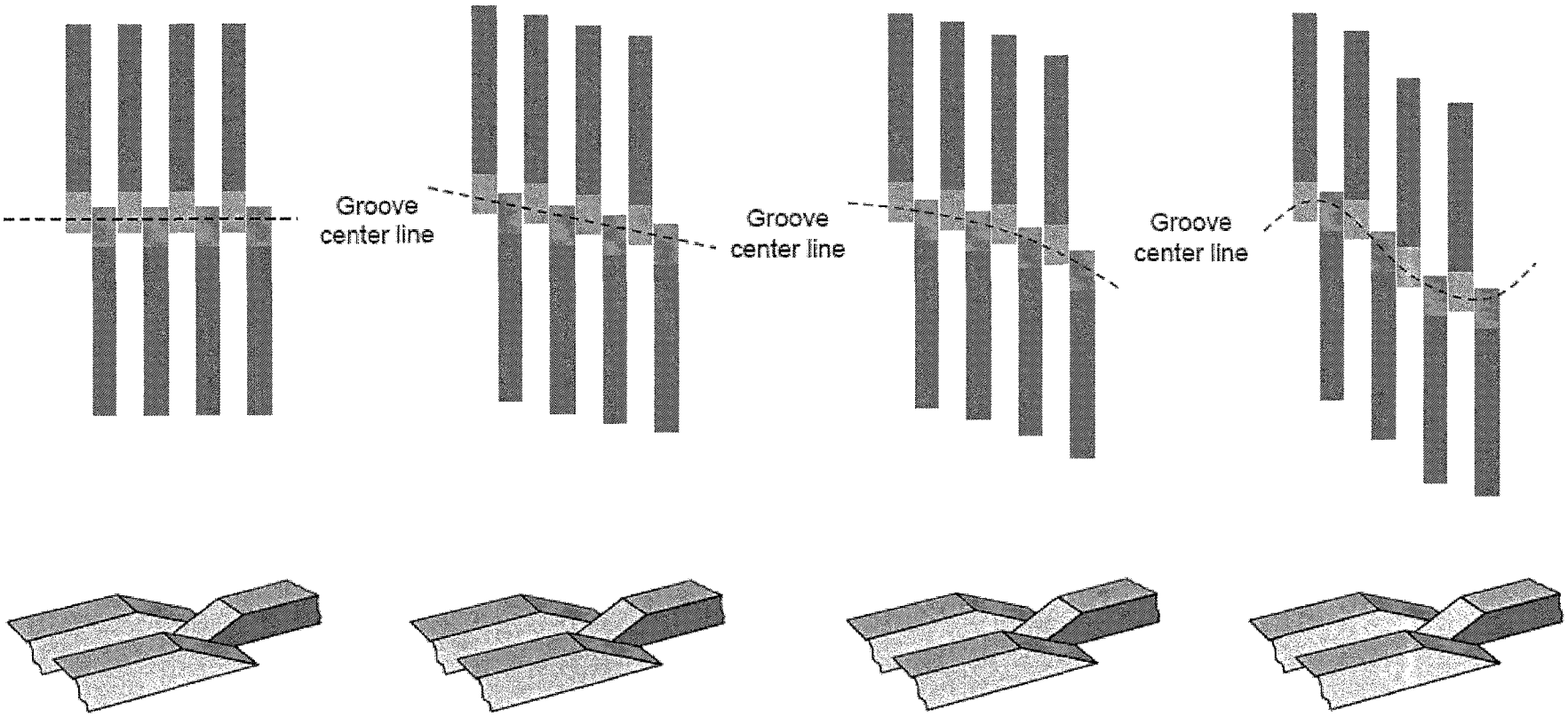

With reference to FIG. 16, a plurality of embodiments of the current disclosure, where the equalization groove 40 diverges from a straight line are illustrated. Starting at the leftmost illustration the equalization groove 40 can be arranged such that its center line forms a straight angle or at a non-straight angle relative the first and second bars 10, 20. Further, the equalization groove 40 can be arranged such that its center line forms an arch or a polynomial curve relative the first and second bars 10, 20.

The embodiments described above are merely given as examples, and it should be understood that the proposed technology is not limited thereto. It will be understood by those skilled in the art that various modifications, combinations and changes may be made to the embodiments without departing from the present scope as defined by the appended claims. In particular, different part solutions in the different embodiments can be combined in other configurations, where technically possible.

The invention claimed is:

1. A refiner segment for a refiner intended for defibrating lignocellulose-containing material, which refiner segment has a refining surface and is arrangeable to form a part of a refining surface of said refiner, said refiner segment having an inlet zone directed in the direction of the feed flow of a material to be refined and a refining zone directed in the direction of the material flow of the refined material, and the refiner segment comprising a plurality of adjacent first bars and a plurality of adjacent second bars, each of said plurality of adjacent first bars and each of said plurality of adjacent second bars having a first end directed in the direction of the inlet zone and a second end directed in the direction of the refining zone, and said plurality of adjacent first bars and said plurality of adjacent second bars alternating with each other such that said plurality of adjacent first bars forms at least one first groove therebetween and said plurality of adjacent second bars forms a plurality of second grooves therebetween, each of said first ends of said plurality of first bars having a width corresponding to a width of each of said plurality of second grooves and said second end of said plurality of adjacent second bars having a width corresponding to a width of said at least one first groove, said second ends of said first bars and said first ends of said second bars overlapping each other so that they are at least in alignment with each other in a direction transverse to said first and second bars said second end of the plurality of adjacent first bars has a first guiding surface decreasing from an upper surface of said plurality of adjacent first bars in the direction of the refining zone to said second end, and said first end of said plurality of adjacent second bars has a second guiding surface increasing from the direction of the inlet zone to an upper surface of said bar towards the second end, and said first and second guiding surfaces are arranged to form an equalization groove across the surface of said first and second bars, wherein said equalization groove is configured to buffer and distribute a flow of material from at least one of said first grooves between said at least two first bars into one or more of said second grooves formed between said plurality of second bars.

2. The refiner segment according to claim 1, wherein said equalization groove, when viewed in a direction perpendicular to a lengthwise direction of said first and second bars and a normal direction to said refiner segment, is formed by inclined opposing surfaces formed by said first guiding surfaces and said second guiding surfaces.

3. The refiner segment according to claim 2, wherein a distance between said inclined opposing surfaces increases along a normal direction to said refining surface.

4. The refiner segment according to claim 3, wherein said increase is linear.

5. The refiner segment according to claim 3, wherein said increase is polynomial.

6. The refiner segment according to claim 3, wherein said equalization groove is v-shaped.

7. The refiner segment according to claim 6, wherein said first guiding surface and said second guiding surface have the same inclination.

8. The refiner segment according to claim 6, wherein said first guiding surface and said second guiding surface have differing inclinations.

9. The refiner segment according to claim 3, wherein said equalization groove has a depth equal to a depth of said first and/or second grooves.

10. The refiner segment according to claim 3, wherein said equalization groove has a depth less than the depth of said first and/or second grooves.

11. The refiner segment according to claim 1, wherein said first and second bars are arranged with different heights.

12. The refiner segment according to claim 1, wherein said first and said second bars are arranged with the same height.

13. The refiner segment according to claim 1, wherein said refiner segment comprises a plurality of groups of first and second bars, each such group comprising a respective equalization groove.

14. A refiner arrangement for defibrating lignocellulose-containing material, comprising at least one refiner segment according to claim 1.

* * * * *